US009056757B1

(12) United States Patent
Stangeland et al.

(10) Patent No.: US 9,056,757 B1
(45) Date of Patent: Jun. 16, 2015

(54) COMBINATION BOTTLE AND CAN OPENER

(71) Applicants: James A. Stangeland, Huntington Beach, CA (US); Paul F. Collins, Orange, CA (US)

(72) Inventors: James A. Stangeland, Huntington Beach, CA (US); Paul F. Collins, Orange, CA (US)

( * ) Notice: Subject to any disclaimer, the term of this patent is extended or adjusted under 35 U.S.C. 154(b) by 224 days.

(21) Appl. No.: 13/779,975

(22) Filed: Feb. 28, 2013

(51) Int. Cl.
*B67B 7/44* (2006.01)

(52) U.S. Cl.
CPC ..... *B67B 7/44* (2013.01)

(58) Field of Classification Search
CPC ..... B67B 7/44
USPC ..... 81/3.09, 3.47, 3.55
See application file for complete search history.

(56) References Cited

U.S. PATENT DOCUMENTS

| | | | | | |
|---|---|---|---|---|---|
| 1,402,470 | A * | 1/1922 | Bauer | 30/429 |
| 1,471,027 | A * | 10/1923 | Hanford | 7/152 |
| 1,678,807 | A * | 7/1928 | Cooper | 7/158 |
| 1,931,697 | A * | 10/1933 | Hill | 81/3.47 |
| 1,963,007 | A * | 6/1934 | Week | 81/3.55 |
| 2,568,612 | A * | 9/1951 | Cullen | 30/450 |
| 2,697,275 | A * | 12/1954 | Moyle | 30/450 |
| 2,856,804 | A * | 10/1958 | Whiteley | 81/3.55 |
| 4,607,407 | A * | 8/1986 | Bergmeister | 7/156 |
| 5,388,297 | A * | 2/1995 | Ross | 7/156 |
| 6,105,468 | A * | 8/2000 | Fohrman et al. | 81/3.09 |
| 6,212,721 | B1 * | 4/2001 | Borodulin et al. | 7/156 |
| 2004/0255722 | A1 * | 12/2004 | So | 81/3.09 |
| 2008/0173134 | A1 * | 7/2008 | Lawson | 81/3.09 |
| 2008/0173136 | A1 * | 7/2008 | Kim | 81/3.55 |

* cited by examiner

*Primary Examiner* — David B Thomas
(74) *Attorney, Agent, or Firm* — Morland C. Fischer

(57) ABSTRACT

A combination bottle opener by which to remove a cap from the top of a bottle and can opener by which to remove a lid from the top of a can. The opener includes a body having a curved head located at one end thereof to surround the bottle cap to be removed and a pair of tapered legs located at the opposite end to fit below the lid to be removed from the can. A force-transmitting plate is affixed to the top of the body so as to extend between the pair of legs. A force applied to the force-transmitting plate of the opener in a first direction causes an edge of the plate to rotate into engagement with the bottle cap to lift the cap off the bottle. A force applied to the force-transmitting plate in an opposite direction causes the tapered legs to rotate into engagement with the lid to pry the lid off the can.

17 Claims, 3 Drawing Sheets

COMBINATION BOTTLE AND CAN OPENER

BACKGROUND OF THE INVENTION

1. Field of the Invention

This invention relates to a combination bottle opener by which to remove a cap from the top of a bottle and can opener by which to remove a lid from the top of a can. The opener has a force-transmitting plate to which forces are applied in opposite directions to either cause a first end of the opener to rotate into engagement with and remove the bottle cap or to cause the opposite end of the opener to rotate into engagement with and pry the lid off the can.

2. Background Art

Occasionally, a workman, a hobbiest, a homeowner or a similar individual will have a need to remove the lid from the top of a can and/or remove the cap from the top of a bottle. In particular, it may be necessary to gain access to the contents (e.g., paint) of a can that is sealed shut by a removable lid. In this same regard, it may also be necessary to gain access to the contents (e.g., a beverage) of a bottle that is sealed shut by a removable cap.

In some cases, the individual will use a conventional bottle opener to remove the bottle cap. In other cases, the individual will use a thin flat blade, such as that common to a screw driver, to pry the lid off the can. In all of the aforementioned cases, the individual is required to have access to two different tools which may take up space and lead to frustration in the event that one or the other of the bottle opener or the can opener is not readily available. Accordingly, it would be desirable to have a single tool to perform the functions of both a bottle opener and a can opener depending upon which end of the tool is being used.

SUMMARY OF THE INVENTION

In general terms, disclosed herein is a combination bottle opener to remove the cap from the top of a bottler and can opener so remove the lid from the top of a can. In a preferred embodiment of the invention, the opener includes a generally U-shaped body having a curved head located at one end of the body and a pair of parallel-aligned legs located at the opposite end. The end of each of the pair of legs is tapered so as to fit below the lip of the lid to be removed from the can. A force-transmitting plate is connected across one side of the body of the opener so as to extend between the pair of legs. An edge of the force-transmitting plate is located in spaced opposing alignment with the curved head at the first end of the body so that the bottle cap to be removed is received through the space between the curved head and the edge of the force-transmitting plate. An arcuate recess may be formed in the edge of the force-transmitting plate in which to receive the lip of the bottle below the bottle cap.

A force applied in a first direction to the force-transmitting plate causes the edge of the plate lying opposite the curved head at the first end of the body to rotate into engagement with the bottle cap so as to lift the cap off the bottle. A force applied in an opposite direction to the force-transmitting plate causes the tapered ends of the pair of legs located at the opposite end of the body to rotate into engagement with the lid to pry the lid off the can.

DESCRIPTION OF THE PREFERRED EMBODIMENT

Figure 1:
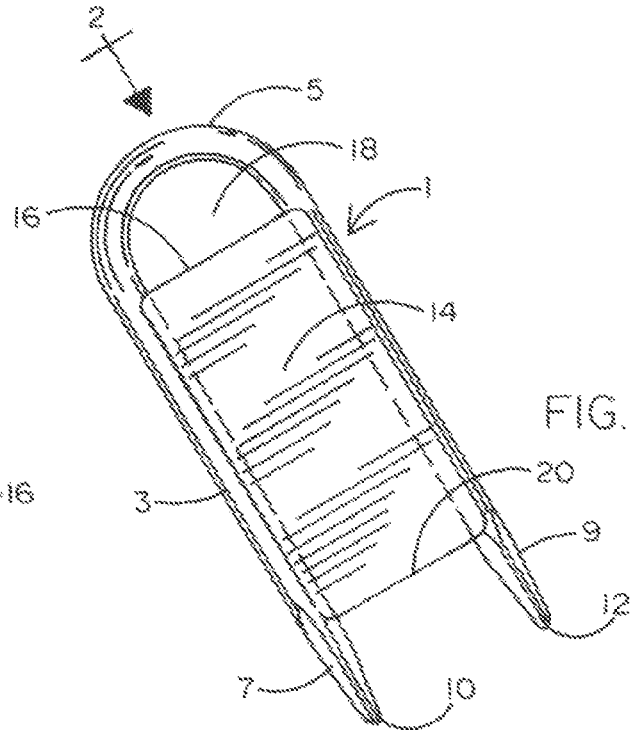
FIG. 1 is a perspective view of a combination bottle cap and can opener according to a first preferred embodiment of this invention.
Figure 2:
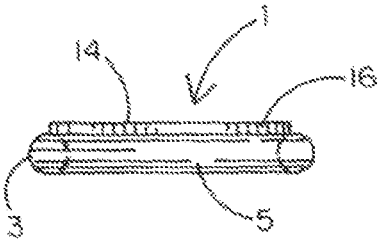
FIG. 2 is a front view of the combination bottle cap and can opener of FIG. 1.

A combination bottle and can opener 1 according to a first preferred embodiment of this invention is described while referring initially to FIGS. 1 and 2 of the drawings. The opener 1 includes a generally U-shaped body 3 having a curved head 5 at a first end thereof and a pair of legs 7 and 9 at the opposite end. The body 3 of the opener 1 is preferably manufactured from steel to maximize the strength thereof. However, the material from which the body 3 is manufactured should not be considered as a limitation of this invention.

The pair of legs 7 and 9 of opener 1 which lie opposite the curved head 5 are disposed in spaced parallel alignment. As an important feature, the tips 10 and 12 of the legs 7 and 9 are ground or filed so as to taper towards a point. By virtue of the foregoing, and as will be explained in greater detail when referring to FIGS. 3 and 4, the curved head 5 and the tapered legs 7 and 9 of the body 3 of the opener 1 enable the opener to be used for the dual purpose of removing the cap from a bottle and removing the lid from a can.

The combination bottle and can opener 1 also includes a force-transmitting plate 14 that is affixed across the top of the U-shaped body 3. Like the body 3, the force-transmitting plate 14 is preferably manufactured from steel for maximum strength. By way of example only, the force-transmitting plate 14 is welded to the body 3 of opener 1. The force-transmitting plate 14 is shown in FIGS. 1 and 2 as having a rectangular configuration. That is, a first straight edge 16 that runs along one end of the force-transmitting plate 14 extends across the body 3 of opener 1 so as to lie opposite the curved head 5, such that a space 18 is located between the curved head 5 of the body 3 and the edge 16 of plate 14. A second straight edge 20 that runs along the opposite end of the force-transmitting plate 14 also extends across the body 3 between the pair of legs 7 and 9.

Figure 3:
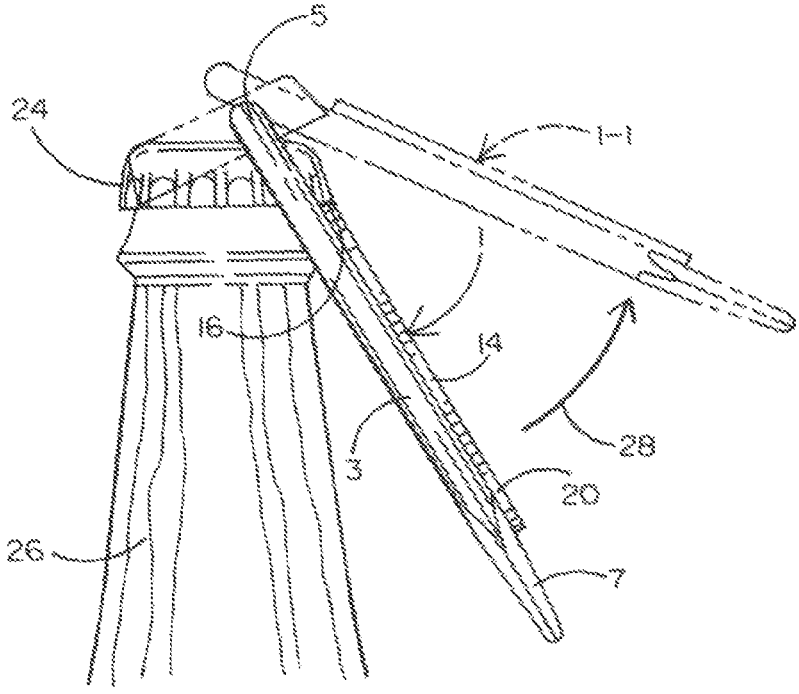
FIG. 3 shows the opener of FIG. 1 being rotated in response to an upward pulling force applied thereto to lift a cap off the top of a bottle.

Turning now to FIG. 3 of the drawings, the combination bottle and can opener 1 is shown being used to remove a lift-off cap 24 from a conventional bottle 26 of the kind commonly used to carry a beverage. To accomplish the foregoing, the opener 1 is held such that the curved head 5 at the first end of the body 3 faces the bottle 26. The opener 1 is moved into engagement with the top of the bottle 26, whereby the bottle cap 24 to be removed is received through the space (designated 18 in FIG. 1) between the curved head 5 and the edge 16 of the force-transmitting plate 14, and the edge 16 is located below the cap 24. An upward pulling force is then applied to the opener 1 in the direction of the reference arrow 28 of FIG. 3 The upward pulling force can be ideally applied to the opener 1 with the user holding his thumb against the force-transmitting plate 14. Accordingly, the opener 1 is rotated against the lip of the bottle 26 to the position shown in phantom lines and designated 1-1 in FIG. 3. The rotation of opener 1 causes a corresponding lifting force to be transmitted from the edge 16 of the force-transmitting plate 14 to the bottle cap 24, whereby the cap 24 is lifted off the bottle 26.

Figure 4:
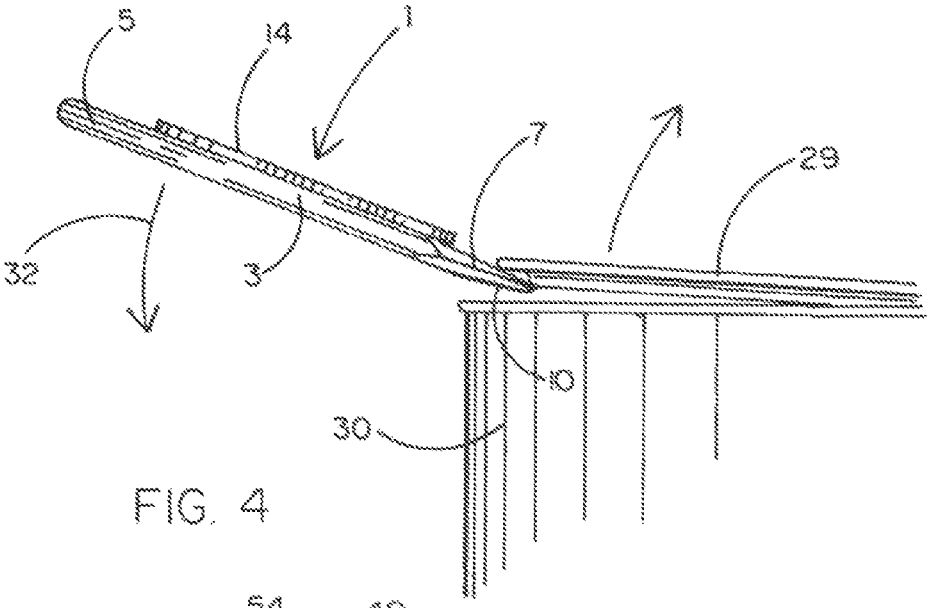
FIG. 4 shows the opener of FIG. 1 being rotated in response to a downward pushing force applied thereto to pry a lid off the top of a can.

FIG. 4 of the drawings shows the combination bottle and can opener 1 being used to remove the lid 29 from a conventional can 30 of the kind commonly used to carry paint. To accomplish the foregoing, the opener 1 is now held such that the tapered tips (only one of which 10 being shown in FIG. 4) of the pair of legs 7 and 9 at the opposite end of the body 3 of opener 1 are moved towards the can and inserted below the lip of the lid 29 to be removed. A downward pushing force is then applied to the opener 1 in the direction of the reference arrow 32 of FIG. 4. The downward pushing force can be ideally applied to the opener 1 with the user pressing his thumb against the force-transmitting plate 14. Accordingly, the opener 1 is rotated against the rim of the can 30 to cause a corresponding lifting force to be transmitted from the tapered tips 10 and 12 of the legs 7 and 9 of the body 3 to the lid 29, whereby to pry the lid upwardly and off the can 30.

Figure 6:
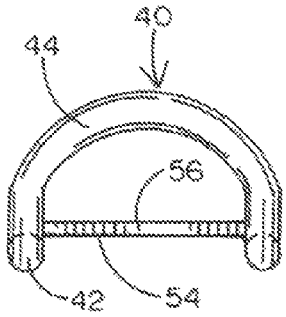
FIG. 6 is a front view of the combination bottle cap and can opener of FIG. 5.
Figure 5:
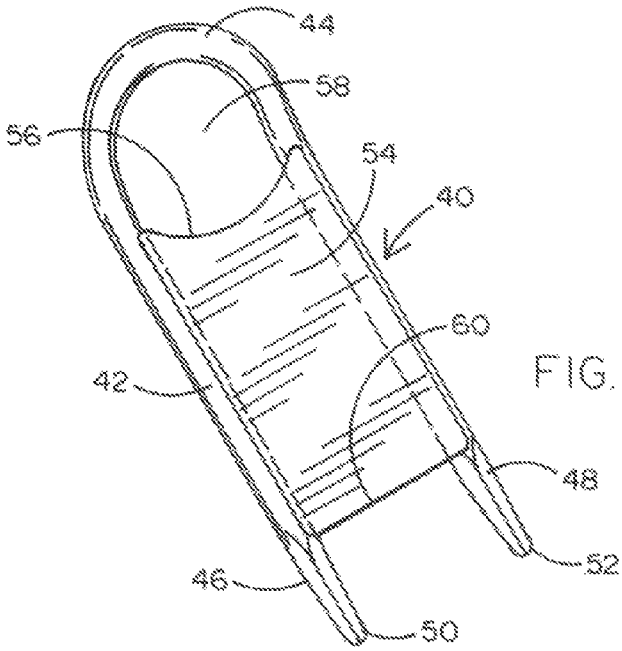
FIG. 5 is a perspective view of a combination bottle cap and can opener according to another preferred embodiment of this invention.

A combination bottle and can opener 40 according to another preferred embodiment of this invention is described while referring initially to FIGS. 5 and 6 of the drawings. Like the opener 1 of FIGS. 1-4, the opener 40 of FIGS. 5 and 6 includes a generally U-shaped (e.g., metallic) body 42 having a curved head 44 at a first end thereof and a pair of legs 46 and 48 at the opposite end. As is best shown in FIG. 7, the curved head 44 bends upwardly from the body 42 of opener 40 to make an angle of about 135 degrees with respect to the oppositely-disposed pair of legs 46 and 48.

The pair of legs 46 and 48 of opener 40 which lie opposite the curved head 44 are disposed in spaced parallel alignment. As an important feature of this embodiment, the tips 50 and 52 of the legs 46 and 48 are ground or filed so as to taper towards a point. By virtue of the foregoing, and as will be explained in greater detail when referring to FIGS. 7 and 8, the curved head 44 and the tapered legs 46 and 48 of the body 42 of the opener 40 enable the opener to be used for the dual purpose of removing the cap from a bottle and removing the lid from a can.

The combination bottle and can opener 40 also includes a (e.g., metallic) force-transmitting plate 54 that is affixed (e.g., welded) across the top of the U-shaped body 42. The force-transmitting plate 54 has a generally rectangular configuration, except that an arcuate recess 56 is formed in one end thereof. The arcuate recess 56 of the force-transmitting plate 54 lies opposite the curved head 44 of the body 3, such that a space 58 is located between the head 44 and the recess 56. A straight edge 60 that runs along the opposite end of the force-transmitting plate 54 extends between the pair of legs 46 and 48.

Figure 7:
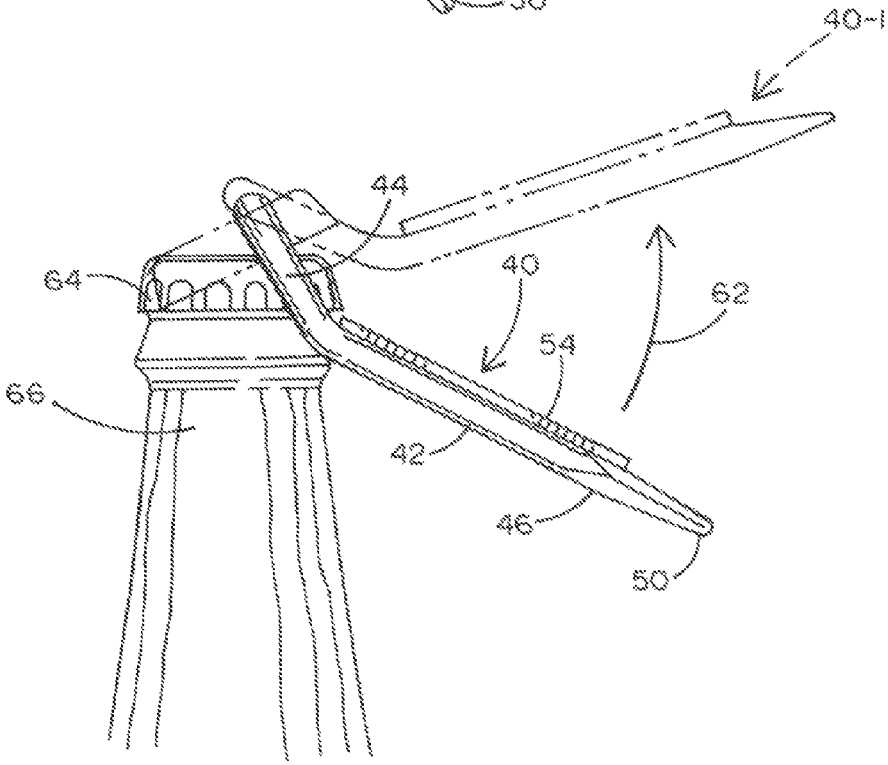
FIG. 7 shows the opener of FIG. 5 being rotated in response to an upward pulling force applied thereto to lift a cap off the top of a bottle.

Referring now to FIG. 7 of the drawings, the combination bottle cap and can opener 40 is shown being used to remove a lift-off cap 64 from a conventional (e.g., beverage) bottle 66. In this case, the opener 40 is held such that the bottle cap 64 to be removed is received through the space (designated 58 in FIG. 5) between the curved head 44 at the first end of the U-shaped body 42 and opposing recess 56 formed in the force-transmitting plate 54. Because the curved head 44 is bent upwardly, the bottle cap 64 is engaged by the curved head 44. The force-transmitting plate 54 is located below the cap 64 such that the lip of the bottle 66 is received within the recess 56.

An upward pulling force is then applied to the opener 40 (e.g., at the force-transmitting plate 54) in the direction of the reference arrow 62 of FIG. 7. Accordingly, the opener 40 is rotated against the lip of bottle 66 to the position shown in phantom lines and designated 40-I. The rotation of opener 40 causes a corresponding lifting force to be transmitted from the recessed edge of the force-transmitting plate 54 to the bottle cap 64, whereby the cap 64 is lifted off the bottle 66.

Figure 8:
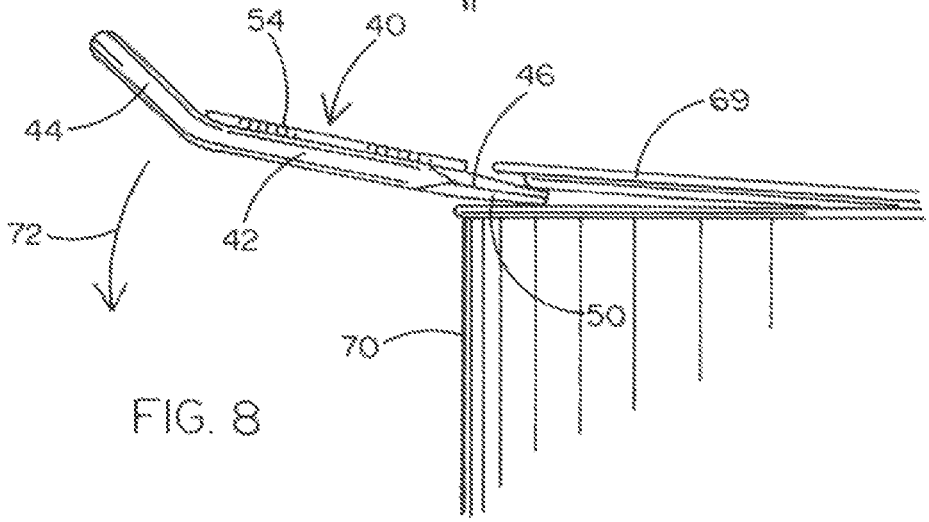
FIG. 8. shows the opener of FIG. 5 being rotated in response to a downward pushing force applied thereto to pry a lid off the top of a can.

FIG. 8 of the drawings shows the combination bottle and can opener 40 being used to remove a lid 69 from a conventional (e.g., paint) can 70. In this case, the opener 40 is now held such that the tapered tips (only one of which 50 being shown in FIG. 8) of the pair of legs 46 and 48 which lie opposite the curved head 44 of the body 42 are moved towards the can 70 and inserted below the lip of the lid 69 to be removed. A downward pushing force is then applied to the opener 40 (e.g., at the force-transmitting plate 54) in the direction of the reference arrow 72. Accordingly, the opener 40 is rotated against the rim of the can 70 to cause a corresponding lifting force to be transmitted from the tapered tips 50 and 52 of the legs 46 and 48 of the body 42 to the lid 69, whereby to pry the lid upwardly and off the can 70.

Figure 9:
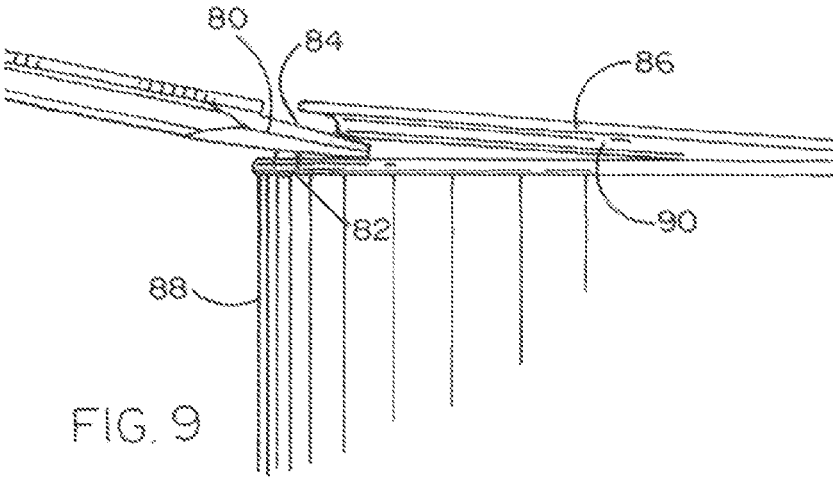
FIG. 9 shows a modification to the openers of FIGS. 1-4 and 5-8.

FIG. 9 of the drawings shows a modification to the combination bottle and can openers 1 of FIGS. 1-4 and 40 of FIGS. 5-8. Like the openers 1 and 40, the modified combination bottle and can opener of FIG. 9 includes a pair of legs (only one of which 80 being visible) that are disposed in spaced parallel alignment. The tips (e.g., 84) of the legs 80 are tapered towards a point. A raised bump or protrusion 82 is located on the bottom of one or both of the tips 84 of the legs 80. When the opener of FIG. 9 is used to remove a lid 86 from a can 88 and the tips 84 of legs 80 are inserted below the lip 90 of the lid 86, the bumps 82 will engage the inside edge of the can 88 to prevent the tips 84 from sliding off the lid 86. The bumps 82 create a stop to ensure that the tips 84 of the legs 80 are positioned inside the can below the lip 90 to generate the lever force necessary to pry the lid 86 off the can 88.

The invention claimed is:

1. An opener to remove a bottle cap from a bottle and a lid from a can, said opener comprising a body, a head located at a first end of said body and being shaped to engage the bottle cap to be removed, at least one leg located at the opposite end of said body to engage the lid to be removed, and a force-transmitting plate connected to said body, such that a force applied in one of first and opposite directions to said opener is correspondingly applied to one of the force-transmitting plate or to the at least one leg depending upon the direction in which said force is applied to said opener for causing either the bottle cap to be removed from the bottle or the lid to be pried off the can, wherein the force applied to the opener in said first direction causes the force-transmitting plate connected to said body to move towards and engage the bottle cap by which the cap is lifted off the bottle.

2. The opener recited in claim 1, wherein the force applied to said opener in said opposite direction causes the at least one leg located at the opposite end of said body to move towards and engage the lid by which to pry the lid off the can.

3. The opener recited in claim 2, wherein the at least one leg located at the opposite end of said body is tapered so as to be sized to fit below the lid of the can to pry the lid off the can in response to the force applied to said opener in said opposite direction.

4. The opener recited in claim 3, wherein the at least one leg located at the opposite end of said body has a bump formed on the bottom of the tapered end thereof and located so as to engage the inside edge of the can, said bump preventing the tapered end from moving outside the can when said one leg is positioned below the lid to pry the lid off the can.

5. The opener recited in claim 2, wherein there are a pair of legs located at the opposite end of said body so as to lie in spaced parallel alignment with one another, said force-transmitting plate being connected across said body so as to extend between said pair of legs, the force applied to said opener in said opposite direction causing said pair of legs to move towards and engage the lid by which to pry the lid off the can.

6. The opener recited in claim 1, wherein said force-transmitting plate connected to said body has an edge that runs across said body such that said edge is disposed in spaced opposing alignment with the head located at the first end of said body, such that a gap is established between said edge and said head through which to receive the bottle cap to be removed.

7. The opener recited in claim 6, wherein said force-transmitting plate is connected to said body such that the edge of said plate is moved towards and into engagement with the bottle cap to lift the cap off the bottle in response to the force applied to said opener in said first direction.

8. The opener recited in claim 6, wherein the edge of said force-transmitting plate has a recess formed therein within which to receive the bottle at a location below the cap to be removed from the bottle in response to the force applied in said first direction to said opener.

9. The opener recited in claim 1, wherein the head located at the first end of said body is curved, such that the curved head surrounds the bottle cap to be removed from the bottle.

10. The opener recited in claim 9, wherein the curved head located at the first end of said body is bent upwardly from said body so that an angle greater than zero is established between said head and the at least one leg located at the opposite end of said body.

11. An opener to remove a bottle cap from a bottle and a lid from a can, said opener comprising a body, a head located at a first end of said body and being shaped to engage the bottle cap to be removed, at least one leg located at the opposite end of said body to engage the lid to be removed, and a force-transmitting plate connected to said body and having an edge that runs across said body such that said edge is disposed in spaced opposing alignment with the head located at the first end of said body, whereby a gap is established between said edge and said head through which to receive the bottle cap to be removed, such that a force applied in one of first and opposite directions to said opener is correspondingly applied to one of the force-transmitting plate or to the at least one leg depending upon the direction in which said force is applied to said opener for causing either the bottle cap to be removed from the bottle or the lid to be pried off the can.

12. The opener recited in claim 11, wherein the edge of said force-transmitting plate has a recess formed therein within which to receive the bottle at a location below the cap to be removed from the bottle in response to the force applied to said opener and correspondingly applied to said force-transmitting plate.

13. The opener recited in claim 11, wherein the force applied to said opener in said first direction causes the edge of said force-transmitting plate connected to said body to move towards and engage the bottle cap by which the cap is lifted off the bottle.

14. The opener recited in claim 13, wherein the force applied to said opener in said opposite direction causes the at least one leg located at the opposite end of said body to move towards and engage the lid by which to pry the lid off the can.

15. The opener recited in claim 11, wherein the head located at the first end of said body is curved, such that the curved head surrounds the bottle cap to be removed from the bottle.

16. The opener recited in claim 15, wherein the curved head located at the first end of said body is bent upwardly from said body so that an angle greater than zero is established between said head and the at least one leg located at the opposite end of said body.

17. An opener to remove a bottle cap from a bottle and a lid from a can, said opener comprising a body, a head located at a first end of said body and being shaped to engage the bottle cap to be removed, at least one leg located at the opposite end of said body to engage the lid to be removed, said head being curved to surround the bottle cap and bending upwardly from said body so that an angle greater than zero is established between the curved head and the at least one leg, and a force-transmitting plate connected to said body and cooperating with said curved head to remove the bottle cap from the bottle, such that a force applied in one of first and opposite directions to said opener is correspondingly applied to one of the force-transmitting plate or to the at least one leg depending upon the direction in which said force is applied to said opener for causing either the bottle cap to be removed from the bottle or the lid to be pried off the can.

* * * * *